US010335841B2

(12) United States Patent
Meyer et al.

(10) Patent No.: US 10,335,841 B2
(45) Date of Patent: Jul. 2, 2019

(54) METHOD OF FORMING AN AL—MG ALLOY PLATE PRODUCT

(71) Applicant: Aleris Rolled Products Germany GmbH, Koblenz (DE)

(72) Inventors: Philippe Meyer, Koblenz (DE); Achim Bürger, Höhr Grenzahusen (DE)

(73) Assignee: ALERIS ROLLED PRODUCTS GERMANY GMBH, Koblenz (DE)

( * ) Notice: Subject to any disclaimer, the term of this patent is extended or adjusted under 35 U.S.C. 154(b) by 803 days.

(21) Appl. No.: 14/762,464

(22) PCT Filed: Jan. 21, 2014

(86) PCT No.: PCT/EP2014/051095
§ 371 (c)(1),
(2) Date: Jul. 21, 2015

(87) PCT Pub. No.: WO2014/114625
PCT Pub. Date: Jul. 31, 2014

(65) Prior Publication Data

US 2015/0360269 A1 Dec. 17, 2015

(30) Foreign Application Priority Data

Jan. 25, 2013 (EP) ..... 13152749

(51) Int. Cl.

| | |
|---|---|
| ***C22C 21/12*** | (2006.01) |
| ***C22C 21/16*** | (2006.01) |
| ***B21C 9/00*** | (2006.01) |
| ***C22C 21/02*** | (2006.01) |
| ***C22C 21/06*** | (2006.01) |
| ***C22C 21/08*** | (2006.01) |
| ***C22C 21/10*** | (2006.01) |
| ***C22F 1/047*** | (2006.01) |
| ***C22F 1/05*** | (2006.01) |
| ***C22F 1/053*** | (2006.01) |
| ***C22F 1/057*** | (2006.01) |
| ***F41H 5/04*** | (2006.01) |
| ***C22C 21/00*** | (2006.01) |
| ***C22F 1/04*** | (2006.01) |

(52) U.S. Cl.
CPC ..... *B21C 9/00* (2013.01); *C22C 21/00* (2013.01); *C22C 21/02* (2013.01); *C22C 21/06* (2013.01); *C22C 21/08* (2013.01); *C22C 21/10* (2013.01); *C22F 1/04* (2013.01); *C22F 1/047* (2013.01); *C22F 1/05* (2013.01); *C22F 1/053* (2013.01); *C22F 1/057* (2013.01); *F41H 5/0414* (2013.01)

(58) Field of Classification Search
CPC ..... B21C 9/00; C22C 21/02; C22C 21/00; C22C 21/06; C22C 21/08; C22C 21/10; C22F 1/04; C22F 1/047; C22F 1/05; C22F 1/053; C22F 1/057; F41H 5/0414
USPC ..... 148/694
See application file for complete search history.

(56) References Cited

U.S. PATENT DOCUMENTS

| | | | | |
|---|---|---|---|---|
| 3,404,998 | A * | 10/1968 | Pesetsky | C23C 16/18 148/525 |
| 3,573,117 | A * | 3/1971 | Cocks | C22C 21/10 148/417 |
| 4,469,537 | A * | 9/1984 | Ashton | F41H 5/02 148/440 |
| 2004/0211498 | A1* | 10/2004 | Keidel | C22C 21/10 148/690 |
| 2006/0130941 | A1 | 6/2006 | Litalien et al. | |
| 2009/0226343 | A1 | 9/2009 | Telioui et al. | |
| 2015/0252453 | A1* | 9/2015 | Aruga | C22C 21/06 420/532 |

FOREIGN PATENT DOCUMENTS

| | | | |
|---|---|---|---|
| CN | 1753740 | A | 3/2006 |
| EP | 1 170 394 | A2 | 1/2002 |
| EP | 2 546 373 | A1 | 1/2013 |
| FR | 2 889 852 | A1 | 2/2007 |
| WO | 2007/020041 | A2 | 2/2007 |
| WO | 2007/115617 | A1 | 10/2007 |
| WO | 2008/098743 | A1 | 8/2008 |

OTHER PUBLICATIONS

International Search Report and the Written Opinion dated Apr. 3, 2014 for International Patent Application No. PCT/EP2014/051095 to Aleris Rolled Products Germany GmbH having an International filing date of Jan. 21, 2014.

International Preliminary Report on Patentability dated Jul. 28, 2015 for PCT International Application No. PCT EP2014/051095, International Filing Date Jan. 21, 2014.

* cited by examiner

*Primary Examiner* — Patricia L. Hailey
(74) *Attorney, Agent, or Firm* — Vorys, Sater, Seymour and Pease LLP

(57) ABSTRACT

The invention relates to a method of forming an AlMg alloy armor plate product, and comprising the steps of: (i) providing a plate product having a gauge of at least 10 mm and a chemical composition, in wt. %: Mg 2.5% to 6%, Mn 0 to 1.2%, Sc 0 to 1%, Ag 0 to 0.5%, Zn 0 to 2%, Cu 0 to 2%, Li 0 to 3%, optionally at least one or more elements selected from the group consisting of (Zr 0.03% to 0.4%, Cr 0.03% to 0.4%, and Ti 0.005% to 0.3%), Fe 0 to 0.4%, Si 0 to 0.25%, inevitable impurities and balance aluminum, and (ii) shaping said alloy plate at a temperature in a range of 200° C. to 400° C. to obtain a predetermined two- or three-dimensional formed structure.

22 Claims, No Drawings

METHOD OF FORMING AN AL—MG ALLOY PLATE PRODUCT

The invention relates to method of shaping or forming Al—Mg armour plate products. The Al—Mg plate product obtained by this method is ideally for use in armoured vehicles applications, and the like.

As will be appreciated herein below, except as otherwise indicated, aluminium alloy designations and temper designations refer to the Aluminium Association designations in Aluminium Standards and Data and the Registration Records, as published by the Aluminium Association in 2012 and are well known to the person skilled in the art.

For any description of alloy compositions or preferred alloy compositions, all references to percentages are by weight percent unless otherwise indicated.

Because of their light weight, aluminium alloys have found wide use in military applications, including military vehicles such as personnel carriers. The light weight of aluminium allows for improved performance and ease of transporting equipment, including air transport of military vehicles. In some vehicles it is advisable to provide shielding or protection against assault, by providing armour plate to protect the occupants of the vehicle. Aluminium has enjoyed substantial use as armour plate, and there are a number of armour plate specifications for the use of different aluminium alloys.

Patent document WO-2008/098743-A1 (Aleris) discloses an Al—Mg alloy armour plate with 4-6% Mg and having a gauge of 10 mm or more, and wherein the alloy plate is obtained by a manufacturing process comprising casting, preheating and/or homogenisation, hot rolling, a first cold working operation, an annealing treatment at a temperature of less than 350° C., followed by a second cold working operation. The end-product is a flat plate product. Preferably after the second cold working operation the plate is not subjected to any further heat-treatment such that no substantial recovery occurs in the alloy plate. The first cold working operation is selected from the group consisting of (i) stretching in a range of 2 to 15%, and (ii) cold rolling with a cold roll reduction in a range of 4% to less than 45%, with preferred narrower ranges. And the second cold working operation selected from the group consisting of (i) stretching in a range of about 2 to 15%, and (ii) cold rolling with a cold roll reduction in a range of about 4% to less than 25%. Stretching is defined as the permanent elongation in the direction of stretching, commonly in the L-direction of the plate product.

Patent document WO-2007/115617-A1 (Aleris) discloses an Al—Mg alloy armour plate with 4.95-6.0% Mg and having a gauge of 10 mm or more, and wherein the plate has an at least 5% improvement in the V50 limit compared to an AA5083-H131 counterpart, as measured by the 30 AMP2 test according to MIL-DTL-46027J of September 1998. Following the hot rolling operation the alloy product is cold worked by means of a cold working operation selected from the group consisting of (i) stretching in a range of 3 to 18% and (ii) cold rolling with a total cold roll reduction in a range of 15% to less than 40%, with preferred narrower ranges.

It is an object of the invention to provide a method of forming or shaping AlMg plate material into a predetermined three-dimensional structure.

This and other objects and further advantages are met or exceeded by the present invention providing a method of forming or shaping an AlMg alloy plate product, and comprising the steps of:

providing a plate product having a gauge of at least 10 mm and a chemical composition, in wt. %:

Mg 2.5% to 6%,

Mn 0 to 1.2%, and preferably 0.05% to 1.2%,

Sc 0 to 1%,

Ag 0 to 0.5%,

Zn 0 to 2%,

Cu 0 to 2%,

Li 0 to 3%, optionally at least one or more elements selected from the group consisting of (Zr 0.03% to 0.4%, Cr 0.03% to 0.4%, and Ti 0.005% to 0.3%), optionally one or more elements selected from the group of (Er, Dy, Gd, and Hf) in a total amount of 0.03% to 0.3%, Fe 0 to 0.4%, Si 0 to 0.25%, inevitable impurities and balance aluminium, and shaping by means of plastic deformation said alloy plate at a temperature in a range of 200° C. to 400° C. to obtain a predetermined two- or three-dimensional formed structure.

In accordance with the invention it has been found that plate products can be hot shaped into two- or three-dimensional structures. It has been found that the hot shaping operation into non-flat products does not lead to any significant loss of the ballistic properties after hot shaping or forming. This may lead to significant advantages in the use of the shaped structure in armour applications, as it avoids or at least reduces the amount of welds in the construction of armoured vehicles. In such armoured vehicles the welds may form the weakest point when subjected to ballistic impact of an incoming projectile. As a consequence when constructing an armoured vehicle comprising a shaped plate it can be constructed using less welds while offering a significantly improved resistance against incoming projectiles and thereby an increased survivability.

In an embodiment the plate product is being shaped using a shaping or forming process selected from the group of bending, pressing, roll forming, stretch-forming, and creep-forming.

Forging as a hot shaping or forming process is not within the scope of the present invention and explicitly disclaimed. Commonly forging of aluminium alloy products is carried out at temperatures above 400° C. Furthermore, a forging operation results in a significant thickness reduction of the subject product, which is not intended in the process according to this invention where some local reduction in thickness may occur, but merely as a result of introducing the predetermined shape into the plate product. The shaped plate product in accordance with this invention is intended to maintain as good as reasonable feasible its gauge prior to shaping in order to provide the required ballistic performance.

In a particular embodiment the plate product is being shaped by means of pressing.

In a particular embodiment the plate product is being shaped by means of stretch-forming.

Plate products have been hot rolled, or hot rolled and subsequently cold rolled such that the end-product is a substantially flat product prior to shaping in accordance with the invention. Optionally, also the rolled plate has been stretched and/or annealed prior to the shaping operation without substantially changing its flat shape.

In an embodiment of the invention, when hot shaped at the lower end of the temperature range, viz. 200° C. to about 300° C., the plate product prior to hot shaping may be in an O-temper or in an H-temper.

In an embodiment of the invention the plate product is being shaped at a temperature in the range of about 200° C. to 350° C. For some alloy compositions there is a need to avoid recrystallisation of the grain structure, and for that reason the shaping temperature should not exceed about 350° C., and preferably it should not exceed about 300° C.

In an embodiment of the invention the plate product which is not sensitive to recrystallisation can be shaped at a temperature in the range of about 200° C. to 400° C. A preferred lower-limit is about 250° C., and more preferably it is about 300° C. In an embodiment the upper-limit is 375° C., and preferably about 350° C. As an illustrative example, an aluminium alloy comprising about 4.5% Mg and about 0.2% Sc, can be hot shaped at a temperature of about 325° C.

In an embodiment of the invention the two- or three-dimensional formed structure is being heat-treated after the forming operation. This will very much depend on the actual alloy composition of the plate product. It can involve a solution heat-treatment by heating the formed structure to a suitable temperature, holding at that temperature long enough to allow at least of the elements like copper, lithium, and zinc to enter into solid solution and cooling rapidly enough (e.g. via quenching) to hold the constituents in solution. The appropriate solution heat treatment practice is dependent on product gauge and the amount of constituents forming elements in the alloy. Thereafter the shaped or formed structure can be aged, natural ageing or artificial ageing, to a T4, T5, T6, or T7 temper.

To obtain optimum benefit of the method according to this invention, in particular when shaped at a temperature in the range of 300° C. to 400° C., the AlMg plate product preferably comprises also at least scandium (Sc) as alloying element up to about 1%. Preferably Sc is present in a range of about 0.05% to 0.4%.

In an embodiment of the invention the aluminium alloy of the plate product has a composition of, in wt. %, Mg about 2.5% to 6%, and preferably about 3.7% to 6%, and more preferably of about 3.7 to 4.7%,
Mn 0 to about 1.2%, and preferably about 0.05% to 1.2%,
Sc 0% to 1%, and preferably 0.05% to 0.4%,
Ag 0 to about 0.5%,
Zn 0 to about 2%,
Cu 0 to about 2%,
Li 0 to about 3%,
optionally at least one or more elements selected from the group consisting of (Zr 0.03% to 0.4%, Cr 0.03% to 0.4%, and Ti 0.005% to 0.3%),
optionally one or more elements selected from the group of (Er, Dy, Gd, and Hf) in a total amount of 0.03% to 0.3%,
Fe 0 to about 0.4%,
Si 0 to about 0.25%,
inevitable impurities and balance aluminium.

Typically inevitable impurities are present in a range of each up to 0.05% and in total up to 0.25%.

Iron can be present in a range of up to about 0.40% and preferably is kept to a maximum of about 0.25%. A typical preferred iron level would be in the range of up to 0.12%, for example about 0.03% or about 0.05%.

Silicon can be present in a range of up to about 0.25% and preferably is kept to a maximum of about 0.2%. A typical preferred Si level would be in the range of up to 0.12%, for example at a level of about 0.04%.

In an embodiment zinc can be present up to about 0.4% as an tolerable impurity. Yet, in another embodiment Zn can be present as a strengthening element in a range of about 0.4% to 2%. A relatively high amount of Zn also has a positive effect of the corrosion resistance of the aluminium alloy. A more preferred upper-limit for the Zn-content is about 0.7%, and more preferably about 0.65%.

Cu can be present in the AlMg-alloy as strengthening element in a range up to about 2%, and preferably up to about 1%. To that effect it includes at least about 0.1% Cu, and more preferably at least about 0.15%. In applications of the alloy product where the corrosion resistance is a very critical engineering property, it is preferred to maintain the Cu at a low level of 0.2% or less, and preferably at a level of 0.1% or less, and more preferably at a level of 0.04% or less.

Li can be present in the AlMg alloy in a range of up to about 3% to provide the product with a low density, high strength, and a very good natural ageing response. If purposively added, the preferred Li level is in the range of 0.5 to 3%, and more preferably in a range of about 0.8 to 2%. In an alternative embodiment there is no purposive addition of Li and should be kept at impurity level of maximum 0.05%, and more preferably the aluminium alloy is lithium-free.

The AlMg alloy preferably has one or more elements selected from the group consisting of Zr 0.03% to 0.4%, Cr 0.03% to 0.4%, and Ti 0.005% to 0.3%. In the Al—Mg the preferred alloying element is Zr. A preferred range of the Zr addition is about 0.05% to 0.2%.

Optionally one or more elements selected from the group of (erbium, dysprosium, gadolinium, and hafnium) can be added whereby the total amount, if added, is in a range of 0.03% to 0.3%. These listed elements can be added to substitute in part the Sc, if added, in the AlMg alloy.

Ti may be added to the AlMg alloy as strengthening element or for improving the corrosion resistance or for grain refiner purposes.

In a particular preferred embodiment the aluminium alloy consisting of, in wt. %:

Mg about 3.8% to 5.1%, and preferably about 3.8% to 4.7%,
Mn 0 to about 0.4%, and preferably 0 to about 0.25%,
Sc 0% to 1%, and preferably 0.05% to 0.4%,
Zn 0 to about 0.4%,
Cu 0 to about 0.25%,
Cr 0 to about 0.12%,
Zr about 0.05 to 0.20%,
Ti 0 to about 0.20%,
Fe 0 to 0.4%, and preferably 0 to about 0.15%,
Si 0 to 0.25%, and preferably 0 to about 0.10%,
others and inevitable impurities each maximum 0.05%, total maximum 0.15, and balance aluminium.

In another particular preferred embodiment the aluminium alloy has a chemical composition within the ranges of AA5024.

In another embodiment of the invention the aluminium alloy of the plate product has a composition of, in wt. %, Mg about 4.95% to 6.0%, preferably about 5.0% to 5.7% Mg, Mn about 0.4% to 1.4%, preferably about 0.6% to 1.2% Mn, Zn up to 0.9%, Zr 0.05% to 0.25%, Cr<0.3%, Sc<0.5%, Ti<0.3%, Fe<0.5%, preferably Fe<0.25%, Si<0.45%, preferably Si<0.2%, Ag<0.4%, Cu<0.6%, other elements and unavoidable impurities each <0.05%, total <0.20%, balance aluminium.

Zinc may facilitate, among other things, improved strength and/or corrosion resistance of the alloy products. When purposeful additions of zinc are included in the alloy, zinc is generally present in an amount of at least 0.3%. In an embodiment, the alloy may include at least 0.35% of zinc. In one embodiment, the alloy includes not greater than 0.9%, and preferably not greater than about 0.7% zinc. In other embodiments, zinc may be present in the alloy as an unavoidable impurity up to 0.3%, and preferably it includes not greater than 0.2% of zinc.

In an embodiment of the alloy, copper can be present in the alloy as strengthening element in a range up to about 0.6%, and preferably up to about 0.5%. To that effect it includes at least about 0.1% Cu, and more preferably at least about 0.15%. Too high amounts of copper may exceed the solubility limit of the alloy when employed with these high amounts of Mg. When Cu is present at these levels, the shaped structure may be subjected to an ageing treatment after the shaping operation, thereby enhancing amongst others the ballistic properties of the shaped alloy products. In applications of the shaped alloy product where the corrosion resistance is a very critical engineering property, it is preferred to maintain the Cu at a low level of 0.2% or less, and preferably at a level of 0.1% or less, and more preferably at a level of 0.04% or less.

In another particular preferred embodiment the aluminium alloy has a chemical composition within the ranges of AA5059.

The formed or shaped plate according to this invention is ideally suitable as armour plate for application in armoured vehicles, in particular armoured military vehicles. The gauge range or thickness range of the aluminium alloy plate is of more than about 10 mm. A suitable upper-limit for aluminium alloy plate is about 100 mm. A preferred gauge range is of about 15 to 75 mm.

A further aspect of the invention relates to a method of use of the shaped aluminium alloy plate product as armour plate in an armoured vehicle, in particular in military vehicles such as Tracked Combat Systems, Armoured Personnel Carriers, Armoured Support Systems, Amphibious Assault Systems, Advanced Assault Amphibious Vehicles or Armed Robotic Vehicles. When applied in such armoured vehicles it will be a form of a configuration such that it forms integral armour. Hang-on armour plate is possible for the aluminium alloy plate according to this invention, but is not the most preferred application.

The invention claimed is:

1. A method of obtaining a predetermined two- or three-dimensional formed structure of an AlMg alloy plate product, comprising the steps of:

providing an alloy plate having a gauge of at least 10 mm and a chemical composition, in wt. %:

Mg 2.5% to 6%,
Mn 0 to 1.2%,
Sc 0 to 1%,
Ag 0 to 0.5%,
Zn 0 to 2%,
Cu 0 to 2%,
Li 0 to 3%,
optionally at least one or more elements selected from the group consisting of Zr 0.03% to 0.4%, Cr 0.03% to 0.4%, and Ti 0.005% to 0.3%,
optionally one or more elements selected from the group of Er, Dy, Gd, and Hf in a total amount of 0.03% to 0.3%,
Fe 0 to 0.4%,
Si 0 to 0.25%,
inevitable impurities and balance aluminium;

shaping or forming the alloy plate at a temperature in a range of 200° C. to 400° C. to obtain the predetermined two- or three-dimensional formed structure; and heat treating the predetermined two- or three-dimensional formed structure.

2. The method according to claim 1, wherein the alloy plate-shaping or forming comprises a shaping or forming process selected from the group of bending, pressing, roll forming, stretch-forming, and creep-forming.

3. The method according to claim 1, wherein the alloy plate has a gauge of 10 mm to 100 mm.

4. The method according to claim 1, wherein the alloy plate is shaped or formed at a temperature in the range of 200° C. to 350° C.

5. The method according to claim 1, wherein the alloy plate is shaped or formed at a temperature in the range of 250° C. to 375° C.

6. The method according to claim 1, wherein the alloy plate is aged after shaping or forming.

7. The method according to claim 1, wherein the chemical composition has Sc in a range of 0.05% to 1%.

8. The method according to claim 1, wherein the chemical composition has Mg in a range of 3.7% to 4.7%.

9. The method according to claim 1, wherein the chemical composition has, Mg 2.5% to 6%,
Mn 0 to 1.2%,
Sc 0 to 1%,
Ag 0 to 0.5%,
Zn 0 to 2%,
Cu 0 to 2%,
Li 0 to 3%,
optionally at least one or more elements selected from the group consisting of Zr 0.03% to 0.4%, Cr 0.03% to 0.4%, and Ti 0.005% to 0.4%,
optionally one or more elements selected from the group of Er, Dy, Gd, and Hf in a total amount of 0.01% to 0.3%,
Fe 0 to 0.4%,
Si 0 to 0.25%,
inevitable impurities and balance aluminium.

10. The method according to claim 1, wherein the chemical composition has a composition within the ranges of AA5024.

11. The method according to claim 1, wherein the chemical composition has, Mg 4.95% to 6.0%,
Mn 0.4% to 1.4%,
Zn 0 to 0.9%,
Zr 0.05% to 0.25%,
Cr<0.3%,
Sc<0.5%,
Ti<0.3%,
Fe<0.5%,
Si<0.45%,
Ag<0.4%,
Cu<0.6%,
other elements and unavoidable impurities each <0.05%, total <0.20%, balance aluminium.

12. The method according to claim 11, wherein the chemical composition has Zn in a range of 0.3% to 0.9%.

13. The method according to claim 11, wherein the chemical composition has Cu in a range of 0.1% to 0.6%.

14. A method of use comprising applying a formed aluminium alloy plate according to claim 1 as armour plate to an armoured vehicle.

15. An armoured vehicle comprising an Al—Mg alloy plate formed according to the method of claim 1.

16. The method according to claim 1, wherein the chemical composition has Mn in a range of 0.05% to 1.2%.

17. The method according to 1, wherein the plate product is shaped or formed at a temperature in the range of 300° C. to 350° C.

18. The method according to claim 1, wherein the chemical composition has Sc in a range of 0.05% to 0.4%.

19. The method according to claim 1, wherein the chemical composition has, Mg 3.7% to 4.7%,
Mn 0.05% to 1.2%,
Sc 0.05% to 0.4%,
Ag 0 to 0.5%,
Zn 0 to 2%,
Cu 0 to 2%,
Li 0 to 3%,
optionally at least one or more elements selected from the group consisting of Zr 0.03% to 0.4%, Cr 0.03% to 0.4%, and Ti 0.005% to 0.4%,
optionally one or more elements selected from the group of Er, Dy, Gd, and Hf in a total amount of 0.01% to 0.3%,
Fe 0 to 0.4%,
Si 0 to 0.25%,
inevitable impurities and balance aluminium.

20. The method according to claim 1, wherein the chemical composition has, Mg 5.0% to 5.7%,
Mn 0.65% to 1.2%,
Zn 0 to 0.9%,
Zr 0.05% to 0.25%,
Cr<0.3%,
Sc<0.5%,
Ti<0.3%,
Fe<0.25%,
Si<0.2%,
Ag<0.4%,
Cu<0.6%,
other elements and unavoidable impurities each <0.05%, total <0.20%, balance aluminium.

21. The method according to claim 1, wherein heat treating of the shaped or formed two- or three-dimensional formed structure is solution heat treatment which takes place at a temperature sufficient to allow at least copper, lithium and zinc to enter into solid solution;

wherein the heat treated shaped or formed two- or three-dimensional formed structure is cooled rapidly enough to maintain the solid solution.

22. The method according to claim 1, wherein, the alloy plate has been hot-rolled or hot-rolled and cold-rolled so that the alloy plate is substantially flat prior to said shaping or forming.

* * * * *